US006857357B2

(12) United States Patent
Fujii

(10) Patent No.: US 6,857,357 B2
(45) Date of Patent: Feb. 22, 2005

(54) ROCKER SWITCH

(75) Inventor: Takeshi Fujii, Tsuruga (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/829,359

(22) Filed: Apr. 22, 2004

(65) Prior Publication Data

US 2005/0006214 A1 Jan. 13, 2005

(30) Foreign Application Priority Data

Jul. 9, 2003 (JP) ..... 2003-194206

(51) Int. Cl.[7] ..... H01H 3/00
(52) U.S. Cl. ..... 100/339
(58) Field of Search ..... 200/553, 556–558, 200/561, 573, 339

(56) References Cited

U.S. PATENT DOCUMENTS 3,679,846 A * 7/1972 Dillon et al. ..... 200/6 A
4,401,864 A * 8/1983 Ichikawa ..... 200/17 R
5,803,243 A * 9/1998 Nestor et al. ..... 200/556
5,934,453 A * 8/1999 Sugawara et al. ..... 200/339
6,355,891 B1 * 3/2002 Ikunami ..... 200/315
6,388,221 B1 * 5/2002 Rudolph et al. ..... 200/556

FOREIGN PATENT DOCUMENTS

JP 06041039 A 2/1994

* cited by examiner

*Primary Examiner*—Michael A. Friedhofer
(74) *Attorney, Agent, or Firm*—Parkhurst & Wendel, L.L.P.

(57) ABSTRACT

A rocker switch includes a drive member which is swingable about a fulcrum, a case supporting the fulcrum of the drive member, and an auxiliary switch. The drive member includes a main body, a push-section provided on the main body, a first stopper provided on the main body and positioned between the first push-section and the fulcrum, and a second stopper provided on the main body, the fulcrum being positioned between the first stopper and the second stopper. The case includes a supporter for supporting the fulcrum of the drive member, and first and second contact sections which the first and second stoppers contact non-simultaneously to each other according to a swinging motion of the drive member, respectively. The rocker switch further includes an urging section for urging the first and second stoppers to the first and second contact sections, respectively. The rocker switch generates a small noise when operating, thus providing quietness.

4 Claims, 6 Drawing Sheets

ROCKER SWITCH

FIELD OF THE INVENTION

The present invention relates to a rocker switch of a swing-action type.

BACKGROUND OF THE INVENTION

Vehicles are recently required to reduce noises in their compartments from engines, and switches for switching of windshield wipers and fog lamps are accordingly required to reduce noises generated from the switches.

FIG. 4 is a cross-sectional view of conventional swing-action type rocker switch 101. FIG. 5 is an exploded perspective view of rocker switch 101. A top surface of operating button 2 protrudes from an upper opening of upper cover 1. Operating button 2 fits in an upper protrusion of drive member 3. Shafts 3A and 3B provided substantially at a center of drive member 3 projects to function as fulcrums and are inserted in supporters 4A and 4B of case 4, respectively. Wiring board 5 has wiring patterns (not shown) formed on top and rear surfaces of the board. The rear surface of wiring board 5 contacts a top surface of lower cover 6. Auxiliary switches 7 and 8 are spaced from each other on the top surface of wiring board 5, and the fulcrums are positioned between auxiliary switch 7 and auxiliary switch 8. Auxiliary switches 7 and 8 have a push-shaft 7A and 8A, respectively. The switches 7 and 8 are self-resetting type switches operable to be turned on when push-shafts 7A and 8A are pushed and to be turned off when the shafts are released. Top surfaces of push-shafts 7A and 8A protrude from openings of case 4 and face push-sections 3C and 3D on the rear surface of drive member 3, respectively. Stoppers 3E and 3F having substantially spherical shapes are located outward from push-sections 3C and 3D and face contact sections 4E and 4F on the top surface of case 4, respectively. Coil spring 9 is accommodated in tubular section 3G projecting out downward substantially from the center of drive member 3. Pin 10 is provided on the bottom end of tubular section 3G. Spring 9, being slightly bent, urges pin 10 toward recess 6A provided unitarily with the bottom section of lower cover 6. A bottom of lower cover 6 has recesses 6B and 6C provided at respective ones of both sides of recess 6A. Spring 9 urges and presses pin 10 against recess 6A, and have drive member 3 located at a neutral position, as shown in FIG. 4. Output terminals 7B and 8B of auxiliary switches 7 and 8 are electrically connected to an electronic circuit (not shown) of the vehicle through connector 5A of wiring board 5.

FIG. 6 is a cross-sectional view of rocker switch 101. When the top surface of operating button 2 is pushed in direction F1, tubular section 3G of drive member 3 swings to a left position of the fulcrum from the neutral position, and pin 10 moves to left from recess 6A. Then, pin 10 moves to recess 6B through passing over protrusion 6D provided between recess 6A and recess 6B. Swinging motion of tubular section 3G stops when stopper 3F on the rear surface of drive member 3 contacts contact section 4F on the top surface of case 4, and a collision noise is generated. Simultaneously, push-section 3D on the rear surface of the drive member pushes push-shaft 8A of auxiliary switch 8, thus turning on auxiliary switch 8. The electronic circuit of the vehicle detects though a signal via terminal 8B and connector 5A that auxiliary switch 8 is turned on, and, for example, causes a wiper to operate intermittently.

Similarly to above, when an upper-left surface of operating button 2 is pushed, tubular section 3G of drive member 3 swings from the neutral position to a right position about the fulcrum, and pin 10 on recess 6A moves to right. Then, pin 10 moves to recess 6C through passing over protrusion 6E provided between recess 6A and recess 6C. The swinging of the tubular section stops when stopper 3E on the rear surface of drive member 3 contacts contact section 4E on the top surface of case 4, and a collision noise is generated. Simultaneously, auxiliary switch 7 is turned on and the electronic circuit of the vehicle detects through a signal provided via terminal 8B and connector 5A that auxiliary switch 7 is turned on, and, for example, causes the wiper to operate continuously.

In order that drive member 3 can keep the neutral position, the left position, and the right position even with shocks and vibrations during driving of the vehicle, spring 9 necessarily has a large urging force.

In conventional rocker switch 101, the large urging force of spring 9 allows stoppers 3E and 3F of drive member 3 to contact sections 4E and 4F with a large force when switching, thus generating a large collision noise.

SUMMARY OF THE INVENTION

A rocker switch includes a drive member which is swingable about a fulcrum, a case supporting the fulcrum of the drive member, and an auxiliary switch. The drive member includes a main body, a push-section provided on the main body, a first stopper provided on the main body and positioned between the first push-section and the fulcrum, and a second stopper provided on the main body, the fulcrum being positioned between the first stopper and the second stopper. The case includes a supporter for supporting the fulcrum of the drive member, and first and second contact sections which the first and second stoppers contact non-simultaneously to each other according to a swinging motion of the drive member, respectively. The rocker switch further includes an urging section for urging the first and second stoppers to the first and second contact sections, respectively.

The rocker switch generates a small noise when operating, thus providing quietness.

DESCRIPTION OF THE PREFERRED EMBODIMENT

Figure 1:
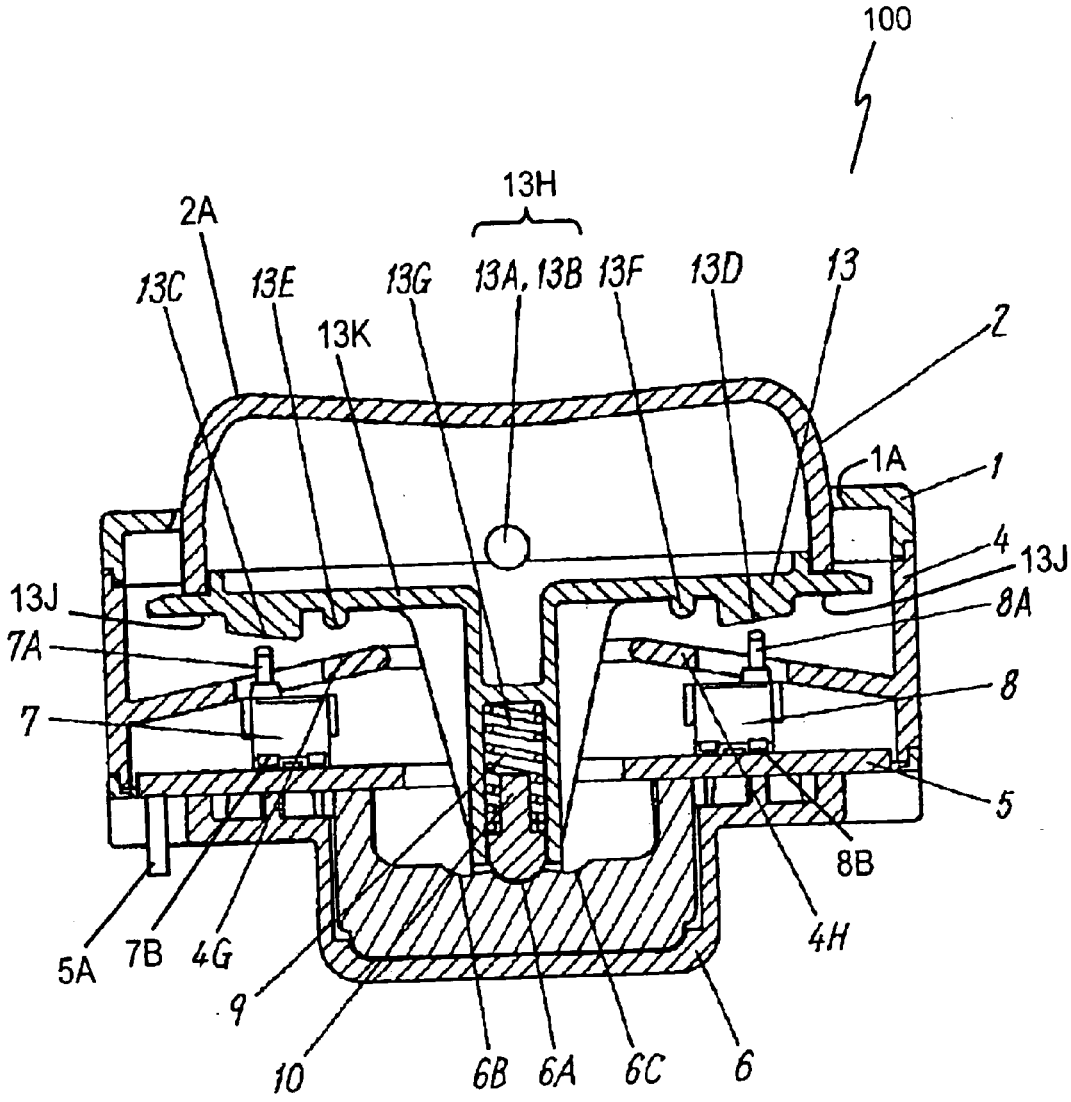
FIG. 1 is a cross-sectional view of a switch according to an exemplary embodiment of the present invention.
Figure 2:
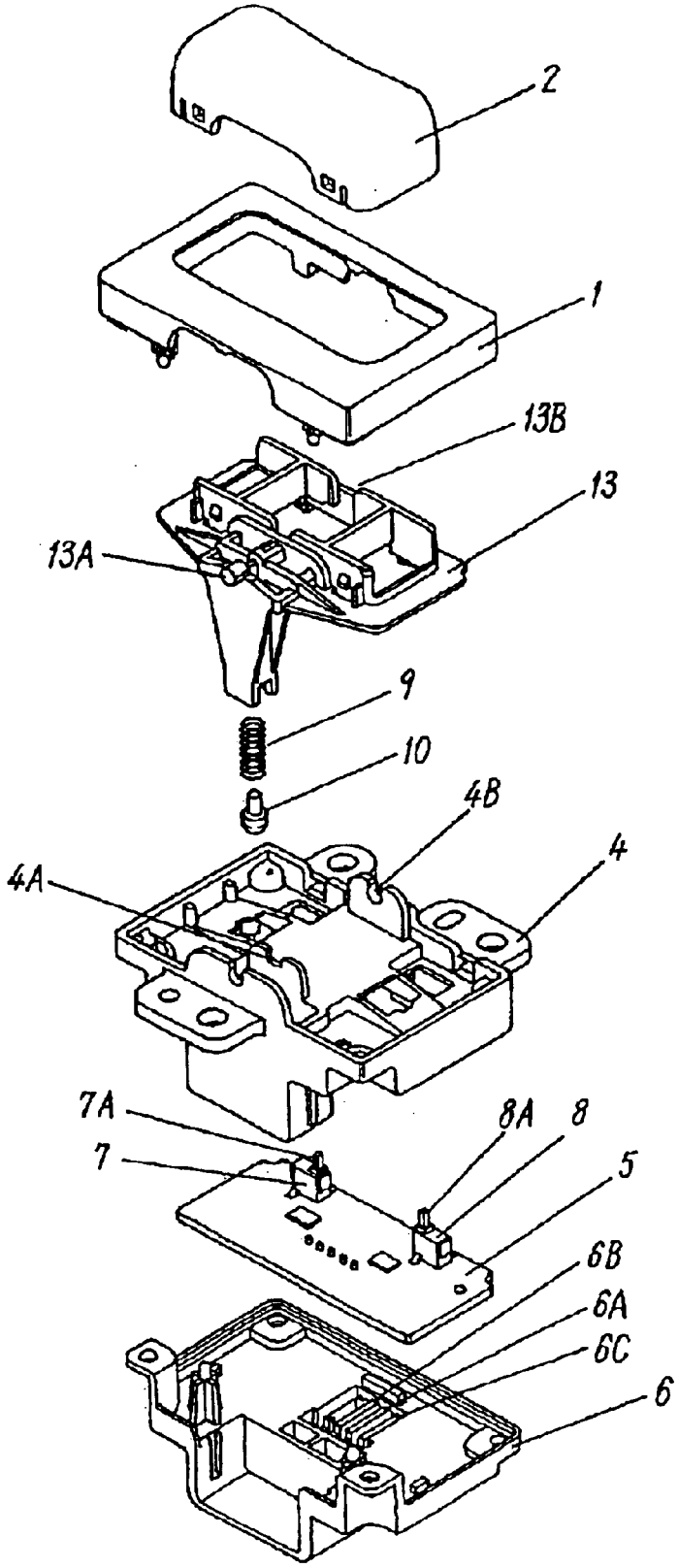
FIG. 2 is an exploded perspective view of the switch according to the embodiment.

FIG. 1 is a cross-sectional view of rocker switch 100 of swing-motion type according to an exemplary embodiment of the present invention. FIG. 2 is an exploded perspective view of rocker switch 100. Top surface 2A of operating button 2 made of insulating resin protrudes from opening 1A in an upper part of upper cover 1 made of insulating resin. Operating button 2 fits in a protrusion on a top surface of drive member 13 made of insulating resin. Shafts 13A and 13B functioning as fulcrum 13H protrude along the antero-posterior axis substantially at a center of drive member 13 and are supported in supporters 4A and 4B of case 4 made of insulating resin, respectively, allowing the drive member to swing. Plural wiring patterns (not shown) are formed on top and rear surfaces of wiring board 5. The rear surface of wiring board 5 contacts a top surface of lower cover 6 made of insulating resin. Auxiliary switches 7 and 8 are provided on the top surface of wiring board 5. Fulcrum 13H is positioned between auxiliary switches 7 and 8. Auxiliary switches 7 and 8 have push-shafts 7A and 8A, respectively. When push-shafts 7A and 8A are pushed, auxiliary switches 7 and 8 are turned on, respectively. When the shafts are released, the auxiliary switches are turned off. That is, auxiliary switches 7 and 8 are automatic-reset type switches operable to be turned on by pushing push-sections 13C and 13D, respectively. Upper surfaces of push shafts 7A and 8A project from openings of case 4 and face push-sections 13C and 13D provided on rear surface 13J of main body 13K of drive member 13, respectively.

Stoppers 13E and 13F having substantially spherical shapes are provided on rear surface 13J of drive member 13. Stoppers 13E and 13F are located closer to fulcrum 13H than push-sections 13C and 13D, respectively, and face contact sections 4G and 4H on the top surface of case 4, respectively. Rear surface 13J of drive member 13 faces contact sections 4G and 4H and push-shafts 7A and 8A of auxiliary switches 7 and 8.

Coil spring 9 is accommodated in tubular section 13G protruding downward substantially from a center of drive member 13. Pin 10 is provided at the bottom end of spring 9. Spring 9, being slightly bent, urges pin 10 toward recess 6A formed unitarily with a bottom of lower cover 6. Output terminals 7B and 8B of auxiliary switches 7 and 8 are electrically connected to an electronic circuit of the vehicle through connector 5A of wiring board 5.

Spring 9 keeps drive member 13 at a neutral position by pushing pin 10 against recess 6A, as shown in FIG. 1.

Figure 3:
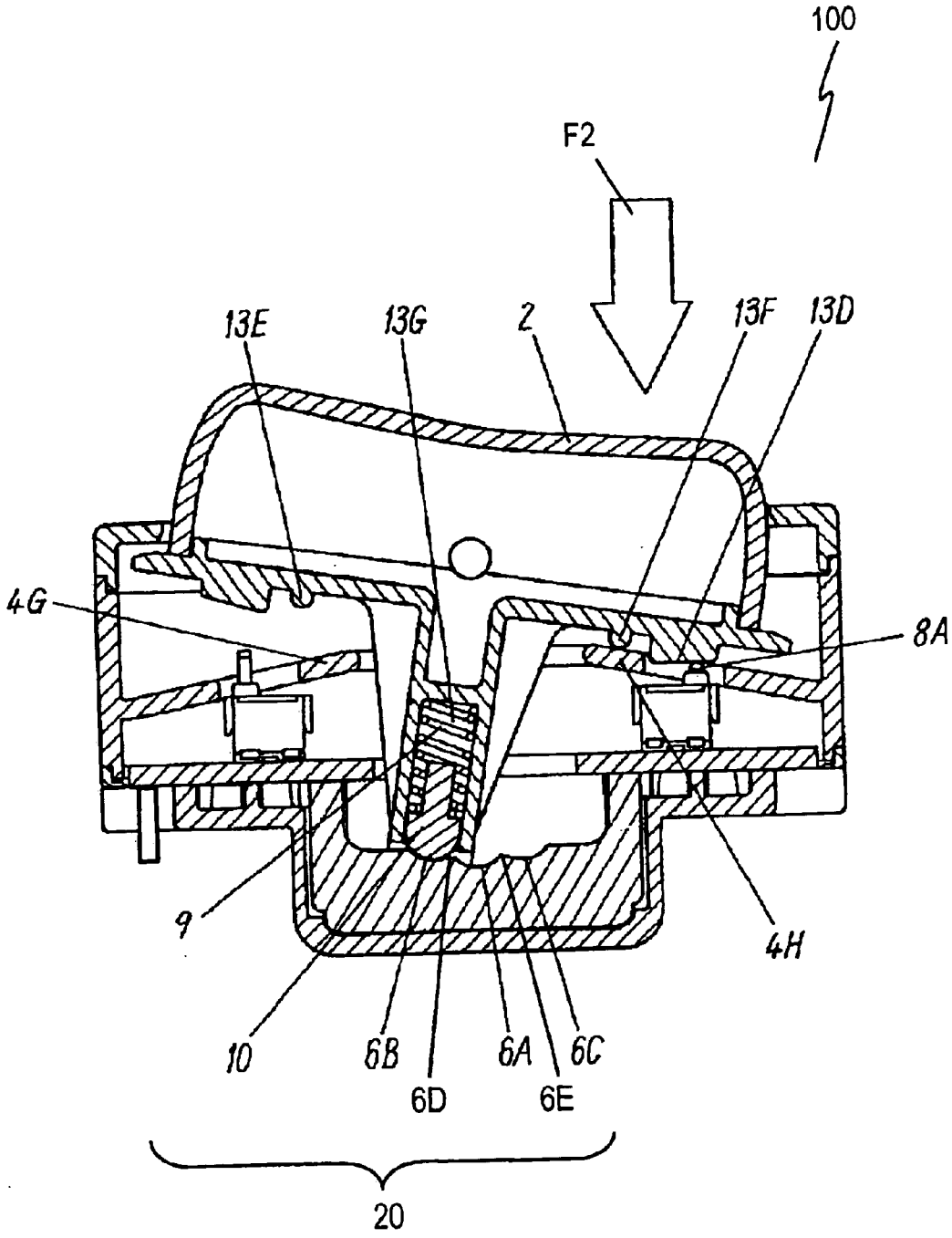
FIG. 3 is a cross-sectional view of the switch according to the embodiment.

FIG. 3 is a cross-sectional view of rocker switch 100 according to the embodiment. As illustrated in FIG. 3, when an upper right surface of operating button 2 is pushed in direction F2, tubular section 13G of drive member 13 swings from the neutral position to a left position about fulcrum 13H, and pin 10 moves from recess 6A to left. Then, pin 10 moves to recess 6B through passing protrusion 6D between recess 6A and recess 6B. Then, stopper 13F on the rear surface of drive member 13 contacts contact section 4H on the top surface of case 4, and stops the swinging motion of tubular section 13G, thereby generating a collision noise.

Figure 4:
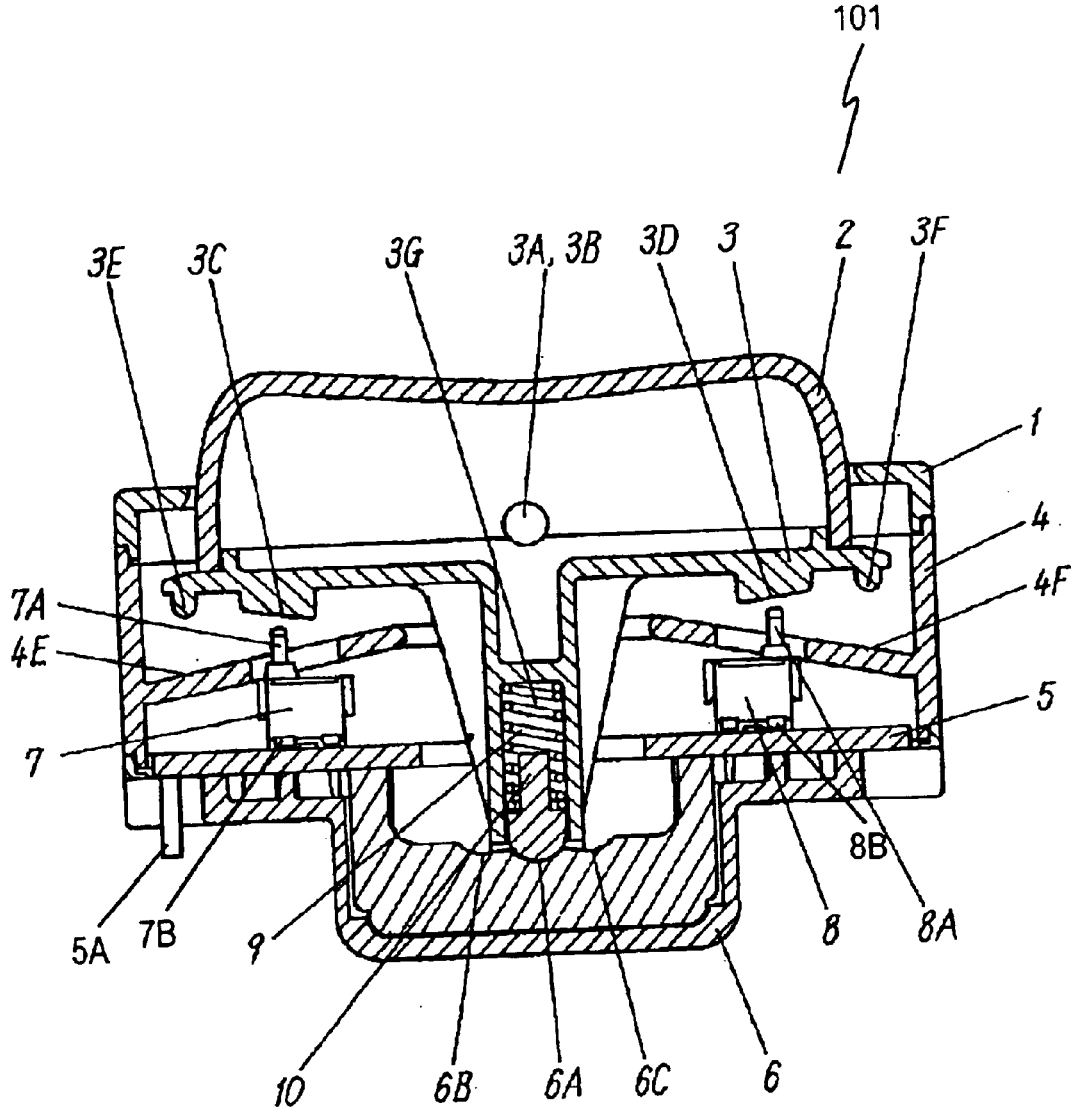
FIG. 4 is a cross-sectional view of a conventional switch.
Figure 5:
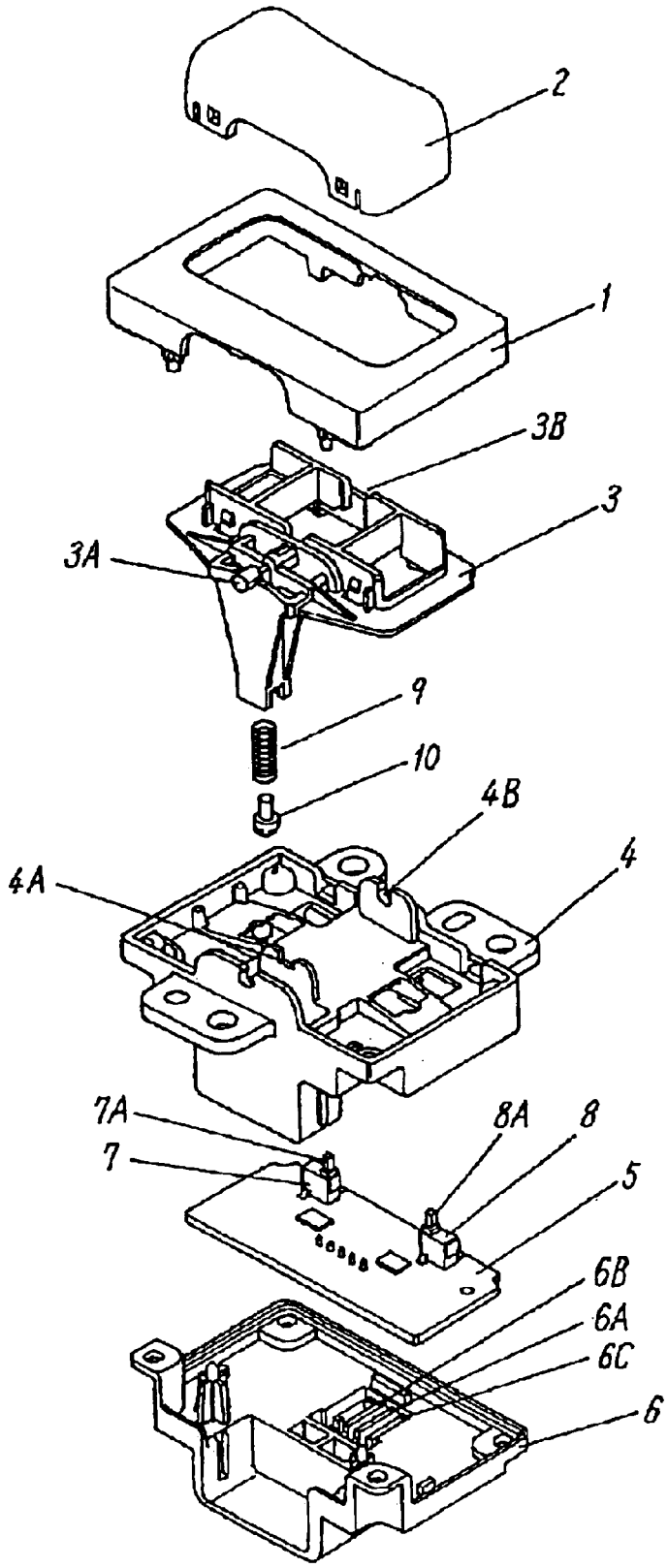
FIG. 5 is an exploded perspective view of the conventional switch.
Figure 6:
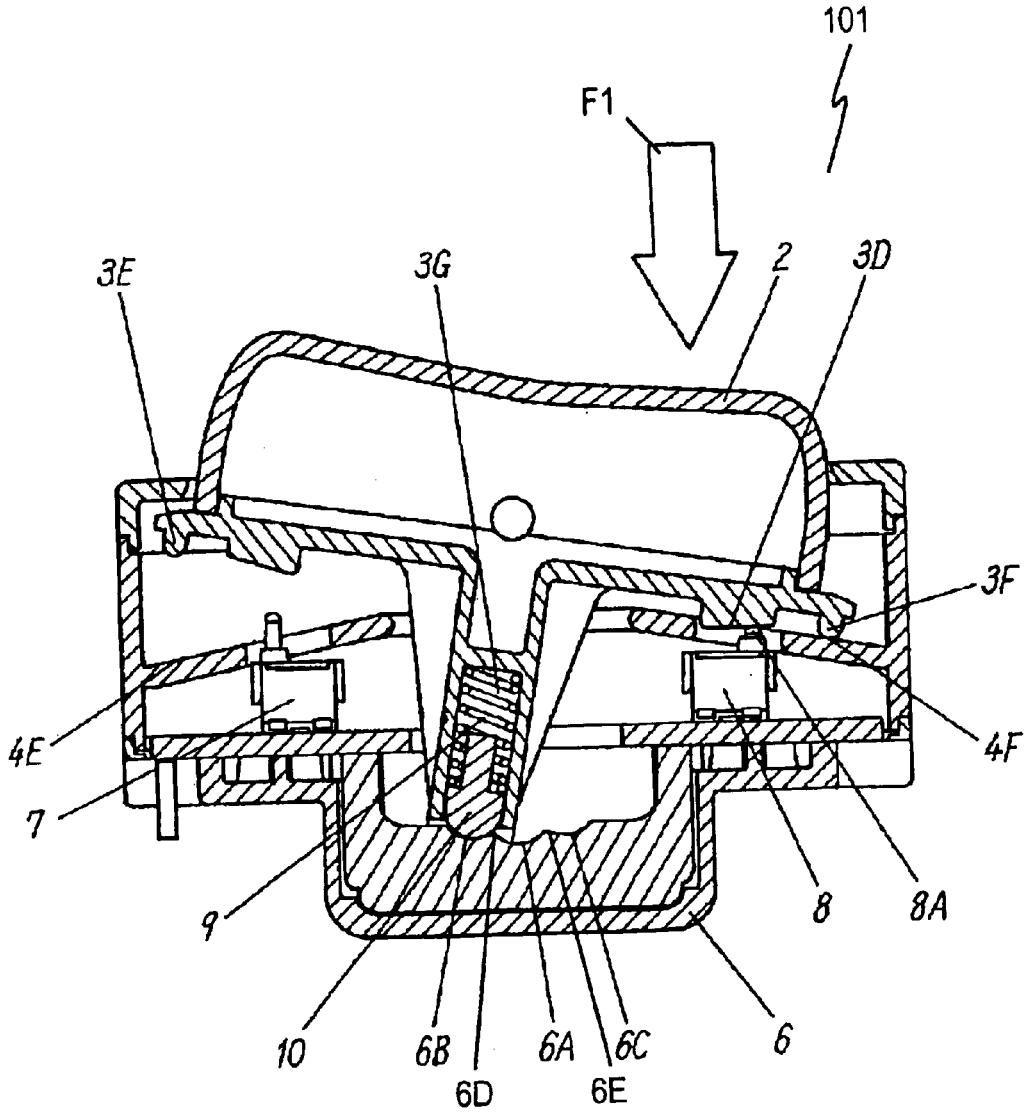
FIG. 6 is a cross-sectional view of the conventional switch.

In rocker switch 100 according to the embodiment, stopper 13F is provided between push-section 13D and fulcrum 13H. This arrangement allows an urging force exerted when stopper 13F contacts contact section 4H of the case to be smaller than an urging force exerted when stopper 3F of conventional rocker switch 101 shown in FIGS. 4 to 6 contacts contact section 4F. Accordingly, the collision noise generated by rocker switch 100 of the embodiment is smaller than that of conventional rocker switch 101, that is, the noise generated during operation of rocker switch 100 is smaller than that of conventional rocker switch 101.

When stopper 13F on the rear surface of drive member 13 contacts contact section 4H on the top surface of case 4, push-section 13D on the rear surface of drive member 13 pushes push-shaft 8A of auxiliary switch 8 and turns on auxiliary switch 8. The electronic circuit of the vehicle detect through a signal via output terminal 8B and connector 5A that auxiliary switch 8 is turned on, and, for example, makes a wiper of the vehicle to operate intermittently.

Similarly to above, when an upper left surface of operating button 2 is pushed, tubular section 13G of drive member 13 swings from the neutral position to right of fulcrum 13H, and pin 10 moves from recess 6A to right. As a result, pin 10 moves to recess 6C through passing over protrusion 6E between recess 6A and recess 6C. Then, stopper 13E on the rear surface of drive member 13 contacts contact section 4G on the top surface of case 4, and the swinging motion of tubular section 13G stops, hence generating a collision noise. That is, the swinging motion of drive member 13 causes stopper 13E to contact contact section 4G non-simultaneously to that stopper 13F contacts contact section 4H. Then, auxiliary switch 7 is turned on, and the electronic circuit of the vehicle detect through a signal via output terminal 7B and connector 5A that auxiliary switch 7 is turned on, thus causing, for example, the wiper of the vehicle to operate continuously.

Spring 9, pin 10, recesses 6A, 6B, and 6C, and protrusions 6D and 6E provide urging section 20 for urging drive member 13 while keeping member 13 at plural positions. That is, urging section 20 keeps drive member 13 at the neutral position as illustrated in FIG. 1 and keeps drive member 13 at a position where stopper 13F contacts contact section 4H as illustrated in FIG. 3. Urging section 20 generates the urging force to press stopper 13F against contact section 4H. Similarly, urging section 20 generates the urging force to press stopper 13E against contact section 4G.

Stoppers 13E and 13F may be made of elastic material, such as rubber or elastomer. The elastic material absorbs the force with which stoppers 13E and 13F contact contact sections 4G and 4H of case 4, thus more reducing the collision noise.

In rocker switch 100 of the embodiment, urging section 20 keeps drive member 13 at three positions, the left, right, and center positions. Urging section 20 keeps drive member 13 at two positions, the left and right positions, namely, the positions at which stoppers 13E and 13F contacts contact sections 4G and 4H, respectively, thus providing the same effect.

In rocker switch 100 of the embodiment, push-sections 13C and 13D push auxiliary switches 7 and 8 at two positions, the left and right positions, of drive member 13, respectively. Rocker switch 100 may include only auxiliary switch 8 without auxiliary switch 7, and drive member 13 may include only push-section 13D without push-section 13C. Although no electrical signal is obtained when pin 10 is positioned on recess 6C, the switch provides the same advantage for the collision noise.

According to the embodiment, urging section 20 including spring 9, pin 10, recesses 6A, 6B, and 6C, and protrusions 6D and GE urges drive member 13 by keeping drive member 13 at the plural positions. Since the swinging motion of drive member 13 stops at positions where stoppers 13E and 13F contact contact sections 4G and 4H, respectively, urging section 20 may not be kept at the positions, providing similar advantage for the collision noise.

What is claimed is:

1. A rocker switch comprising:

a drive member which is swingable about a fulcrum, the drive member including:

a main body, a first push-section provided on the main body, a first stopper provided on the main body and positioned between the first push-section and the fulcrum, and a second stopper provided on the main body, the fulcrum being positioned between the first stopper and the second stopper;

a case including a supporter for supporting the fulcrum of the drive member, and first and second contact sections that contact the first and second stoppers non-simultaneously to each other according to a swinging motion of the drive member, respectively;

an urging section for urging the first and second stoppers to the first and second contact sections, respectively; and a first auxiliary switch operable to be turned on or off by being pushed by the first push-section.

2. The rocker switch of claim 1, wherein the drive member further includes a second push-section, the second stopper being positioned between the second push-section and the fulcrum, said rocker switch further comprising a second auxiliary switch operable to be turned on or off by being pushed by the second push-section.

3. The rocker switch of claim 1 wherein the urging section is operable to keep the drive member at a position where the first stopper contacts the first contact section and at a position where the second stopper contacts the second contact section.

4. The rocker switch of claim 1 wherein the first and second stoppers comprises elastic material.

* * * * *